United States Patent [19]

Reuter

[11] 4,335,767

[45] Jun. 22, 1982

[54] METHOD AND APPARATUS FOR THE CHIPPING DISSECTION OF TREE LOGS INTO ALL-ROUND MACHINED LUMBER PRODUCTS

[75] Inventor: Alfred Reuter, Oberkirch, Fed. Rep. of Germany

[73] Assignee: Gebruder Linck, Maschinenfabrik und Eisengiesserei "Gatterlinck", Oberkirch, Fed. Rep. of Germany

[21] Appl. No.: 140,841

[22] Filed: Apr. 16, 1980

[30] Foreign Application Priority Data

May 9, 1979 [DE] Fed. Rep. of Germany ..... 2918622

[51] Int. Cl.[3] ..... B27C 9/10

[52] U.S. Cl. ..... 144/370; 144/3 R; 144/378; 144/39

[58] Field of Search ..... 144/1 R, 3 R, 37, 39, 144/41, 312, 326 R, 322, 323

[56] References Cited

U.S. PATENT DOCUMENTS

| | | | |
|---|---|---|---|
| 3,486,541 | 12/1969 | Nilsson | 144/312 |
| 3,552,457 | 1/1971 | Bos | 144/312 |
| 3,742,993 | 7/1973 | Morton et al. | 144/39 |
| 3,880,215 | 4/1975 | Mallery | 144/326 R |
| 4,009,741 | 3/1977 | Zimmerman | 144/39 |
| 4,239,069 | 12/1980 | Zimmerman | 144/39 |
| 4,239,072 | 12/1980 | Merilainen | 144/312 |

FOREIGN PATENT DOCUMENTS

| | | | |
|---|---|---|---|
| 771449 | 11/1967 | Canada | 144/39 |
| 2010060 | 5/1978 | Fed. Rep. of Germany | 144/39 |

*Primary Examiner*—W. D. Bray

*Attorney, Agent, or Firm*—Schmidt, Johnson, Hovey & Williams

[57] ABSTRACT

An improved method and apparatus for efficiently producing machined lumber products such as boards and squared timber is described wherein, after initial four-sided planing of a log, the remaining wany edge regions are milled using saw/chipper units which present, at each milled region, a relatively smooth and a relatively rough surface. The final step in log processing involves sawing the log along the plane of the rough milled surfaces so as to yield a pair of substantially smooth, severed boards, as well as a smooth central timber or cant. The apparatus includes respective, carriage-mounted, shiftably adjustable heads (each having a chopping tooth member and an adjacent saw blade of substantially the same diameter) along with cooperating second saw blades.

7 Claims, 5 Drawing Figures

Figure 1:
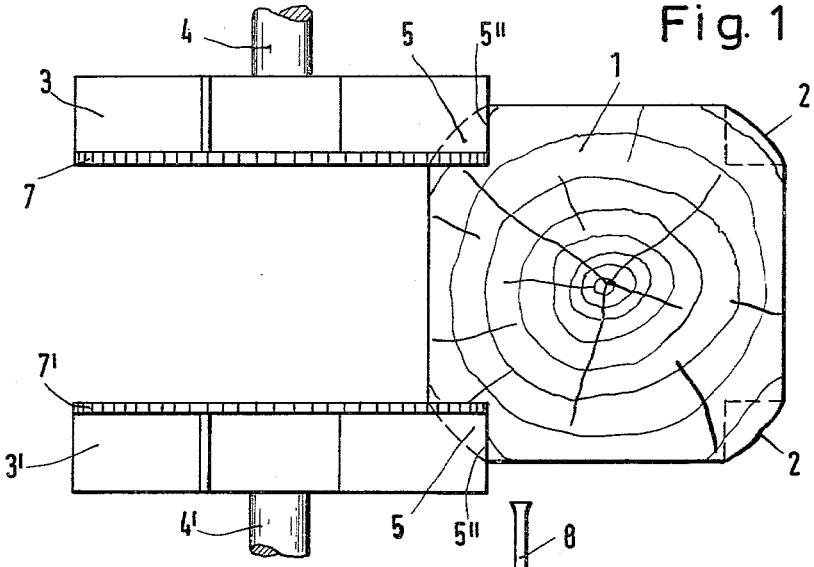

METHOD AND APPARATUS FOR THE CHIPPING DISSECTION OF TREE LOGS INTO ALL-ROUND MACHINED LUMBER PRODUCTS

The invention relates to a method for the chipping dissection of tree logs into all-round machined lumber products, such as boards and squared timber, whereby the wany edges of the tree logs, which have first been flattened on all four sides, are rectangularly milled out and, subsequently, at least two lateral boards are separated by means of saw cuts. The invention also relates to an apparatus to perform the process.

It is known to prepare tree logs, before being sawed up into boards, in such a manner that, first, the four sides of the tree trunk are flattened and chips are produced of the remaining wany tree edges by means of cutter heads. When used for cellulose production and for the production of chip boards, the chips shall have a length of about 25 mm but at least of about 16 mm. When cutting these comparatively long chopped chips from the wany tree edges of the tree log, very rough, chopped surfaces are obtained. Owing to the high chip removal per cutter knife, the surface produced at the circumference of the cutter head is wavy while the surface produced with the front face of the cutter head is very rough; both surfaces have tears, especially at the branches.

It is, therefore, the object of the invention to provide a method of the kind mentioned in the introduction with which lumber products, such as boards and squared timber, can be produced which have all-around the same high surface quality while the production of chips is maintained.

According to the invention this object is accomplished in that, when milling out the wany edges, always one of the two processed, rectangularly disposed surfaces is sawed and the remaining material is milled out as chopped chips and that the subject saw cut for the separation of a lateral board is advanced along the other of the two processed surfaces.

In this manner, also the narrow edge faces of the lateral board are processed to a sufficiently fine degree because the one surface of each cut out edge is directly sawed while the other surface is initially provided with a wavy surface produced by the chopping teeth but is then subjected to fine processing by the subsequent saw cut with which the lateral board is separated.

For the accomplishment of the method according to the invention, an apparatus is provided comprising edge milling cutter heads to mill out the wany tree edges and circular saws operating opposite each other always in a common plane having parallel axes of rotation to separate the lateral boards being characterized in that the edge milling cutter heads are designed as chopping tooth cutters, each one being provided with a circular saw blade at its front face having approximately the same effective diameter as that of the chopping teeth and in that the axes of rotation of the circular saws for the separation of the lateral boards are arranged in a rectangular relationship to the axes of rotation of the edge milling cutter heads.

In comparison with known devices, it is accomplished, without any remarkable increase in construction complexity, that the lumber products, such as boards and/or squared timber, made in this manner have all-around sawed surfaces without having to give up the production of wood chips for further utilization.

Figure 2:
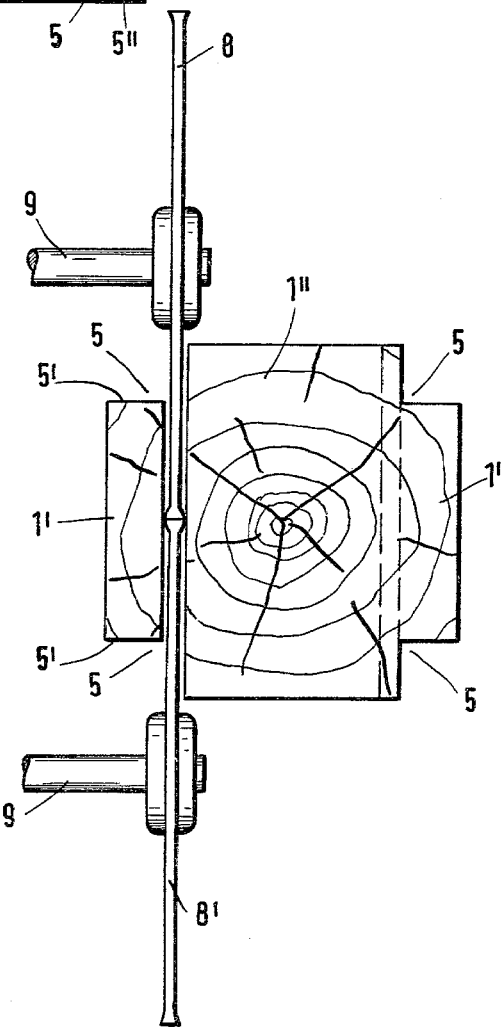
Figure 3:
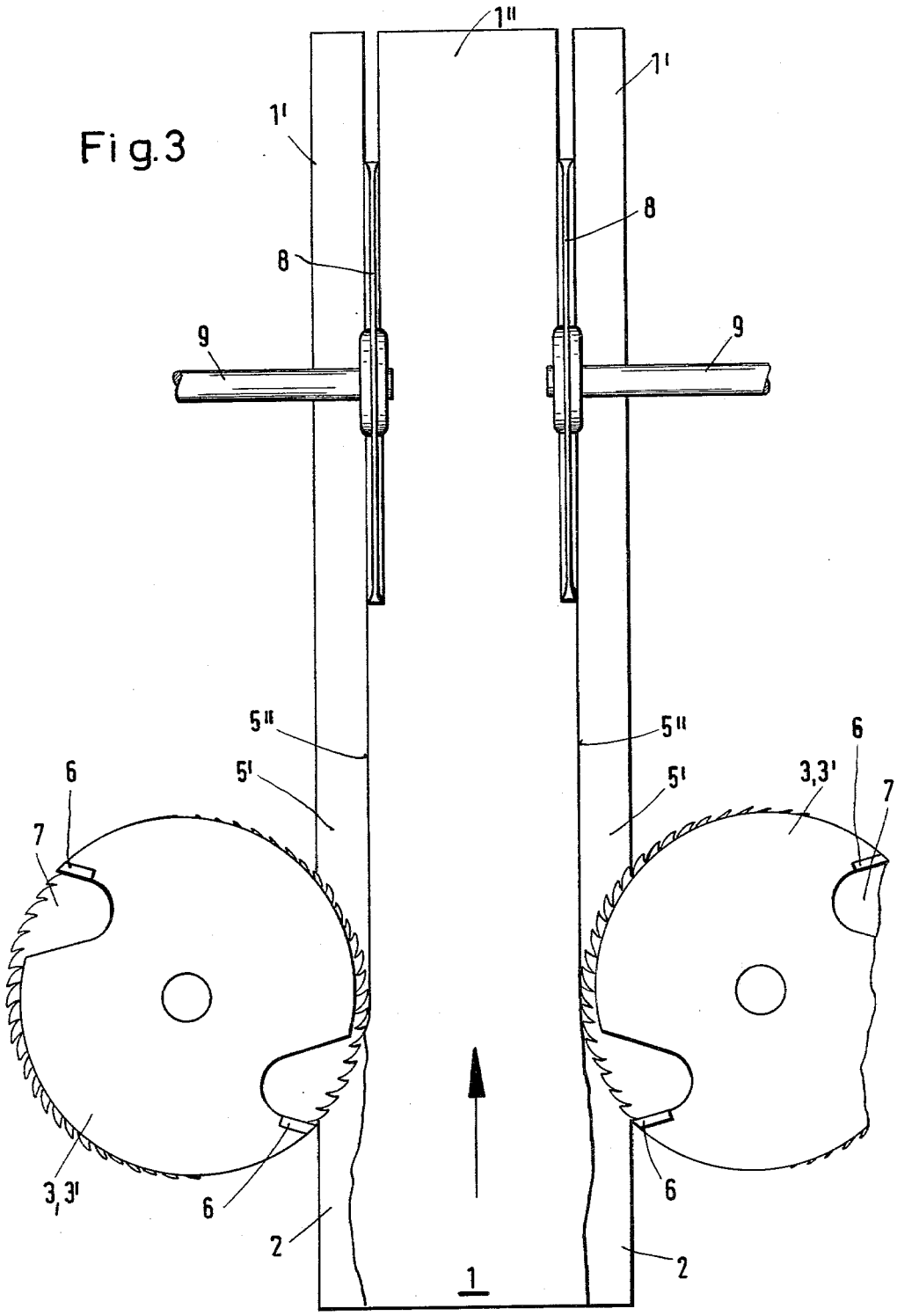
Figure 4:
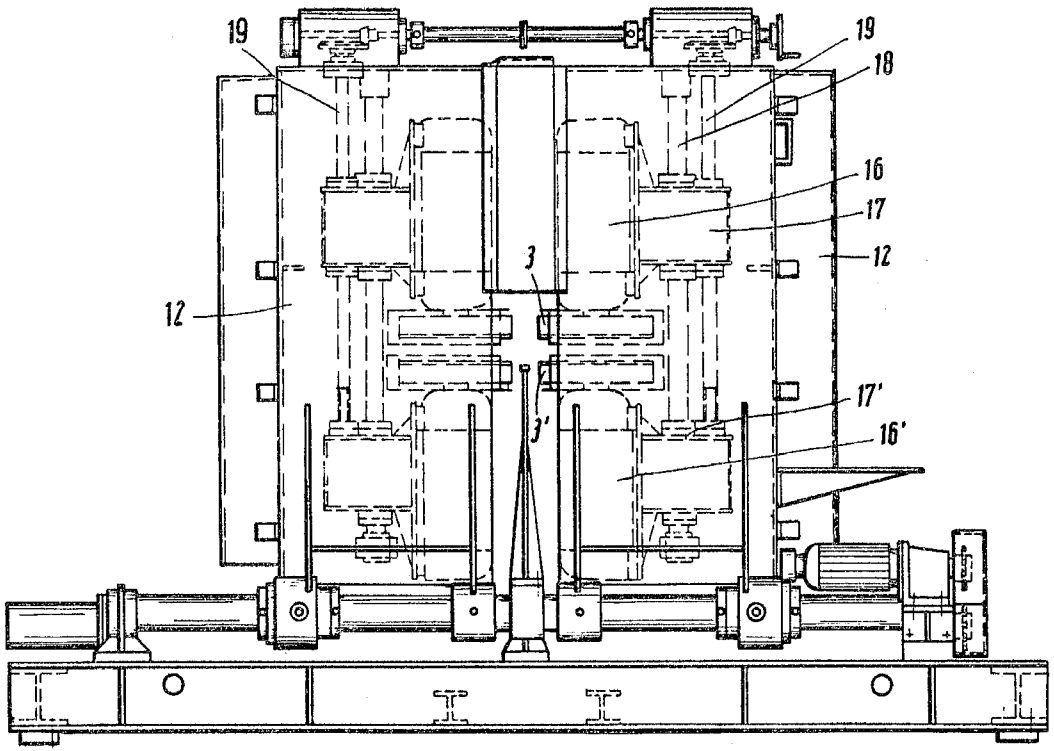
Figure 5:
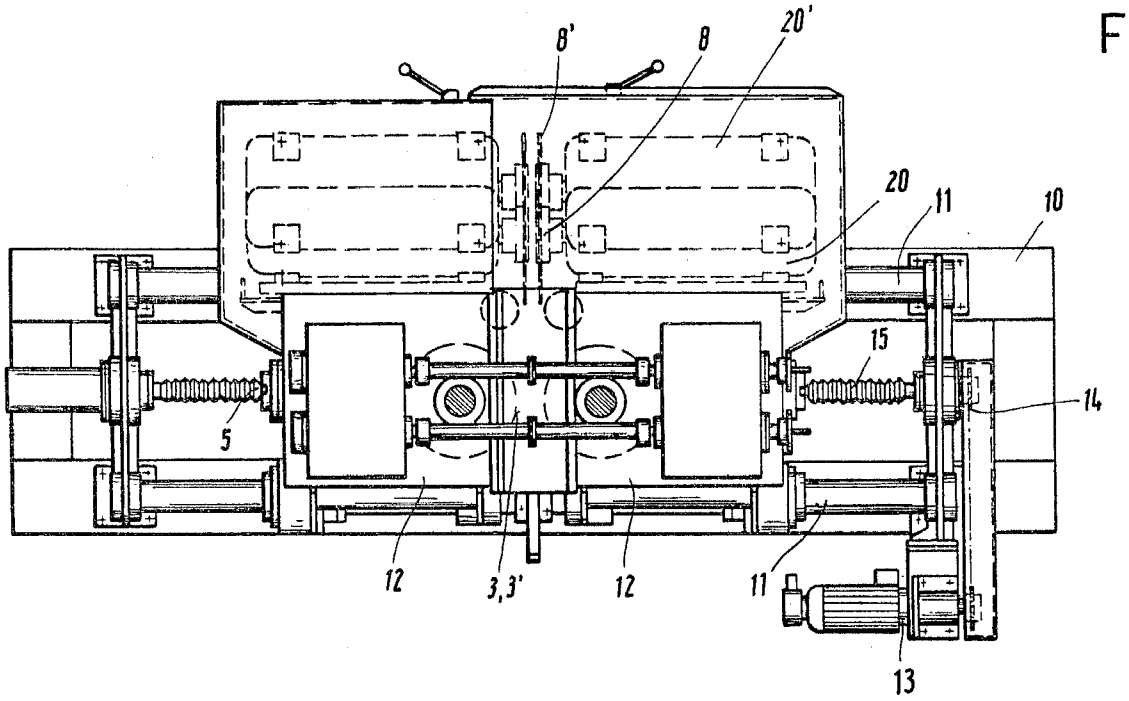

Additional advantageous features of the invention are further explained below with the help of an exemplified embodiment shown in the drawing, showing in:

FIG. 1: in vertical cross-section the processing of the wany edges of a tree log initially flattened on four sides;

FIG. 2: the subsequent separation of a lateral board also in a vertical cross-section;

FIG. 3: a top view of the tools working on the tree log and shown in FIGS. 1 and 2;

FIG. 4: a front view of the apparatus in which the tools shown in FIGS. 1–3 are arranged;

FIG. 5: a top view of the apparatus shown in FIG. 4.

A tree log 1 flattened on four sides, but still having unprocessed wany edges 2, is first processed by cutter heads 3, 3′ aligned in pairs with vertical driving shafts 4, 4′ whereby rectangular recesses 5 are milled out at the log edges 2.

The cutters 3, 3′, each of which has two chopping knives 6, are equipped on one of their faces with a circular saw blade 7, the outer active diameter of which corresponds to the active diameter of the chopping knives 6.

After the cutter heads 3, 3′ have passed through the log, the wood surfaces 5′ which have been machined by the front faces of the cutter heads 3, 3′ are sawed while the surfaces 5″ located at a right angle to the latter surfaces are wavy and have a torn aspect owing to the operation of the chopping teeth of the cutter heads.

Subsequently, two circular saws 8, 8′, arranged in a common plane, with horizontal driving shafts 9 in parallel to each other saw along the surfaces 5″ and are advanced to such a depth that a lateral board 1′ is completely separated. A piece of squared timber 1″ remains between the two pairs of circular saws 8, 8′ which, if so desired, can be further processed into boards.

It can be noted from FIGS. 2 and 3 that the circular saws 8, 8′ operate in the plane of the surfaces 5′ and thus give a smooth finish also to this initially wavy and torn surface so that all surfaces of the lumber products 1′, 1″ have smoothly sawed surfaces when also the outer surfaces of the flattened tree log were processed on this quality level.

The direction of advance of the tree log 1 is marked by an arrow in FIG. 3.

The apparatus shown in FIGS. 4 and 5 which serves the purpose of supporting and driving the tools shown in FIGS. 1 to 3 comprises a base frame 10 with two circular guides 11 on which two sliding carriages 12 are guided in a laterally adjustable manner. The adjustment operation is effected by means of a geared motor 13 throught a chain drive 14 and adjustable spindles 15.

In each of the two sliding carriages 12, two motors 16, 16′ are attached to further sliding carriages 17, 17′ respectively which are guided for vertical adjustment in circular guides 18. The vertical adjustment is effected by means of adjustable spindles 19 which are jointly driven. The motors 16 and 16′ drive the cutter heads 3 and 3′.

Driving motors 20 and 20′ (in FIG. 5 only indicated by dotted lines) for the circular saws 8 and 8′ are also attached to the sliding carriages 12 so that the adjustment in width of the circular saws 8, 8′ is coupled with the lateral adjustment of the cutter heads 3, 3′.

Means for the guidance and advance of the tree logs and of the produced boards and/or the pieces of squared timber are commonly known and have been omitted in the drawing for reasons of simplification. An arrangement for the initial flattening of the tree logs is as well known in the art. The flattening may be effected directly in line before the tree log is fed into the apparatus according to FIGS. 4 and 5 in the same passage or in a separate step before the tree log is fed to the apparatus according to the invention.

What is claimed is:

1. A method of processing a log to produce lumber, comprising the steps of:

cutting said log to present four flattened faces thereon with wany edge regions between adjacent faces, said faces being substantially at right angles relative to each other and arranged in pairs with the faces of each pair being generally opposed;

milling said wany edge regions to present, at each such region, a pair of generally planar, interconnected surfaces, said milling step being accomplished, at each such region, by sawing the log to produce one of said surfaces and to render the one surface relatively smooth, and by chipping the log to produce the other of said surfaces which renders the other surface relatively rough, two of said rough surfaces lying generally in a first plane, and the remaining two of said rough surfaces lying generally in a second plane; and sawing said log along said first and second planes to separate two boards from said log and leave a central cant, said last-mentioned sawing serving to smooth said initially rough surfaces.

2. The method as set forth in claim 1, said sawing and chipping steps being performed simultaneously.

3. The method as set forth in claim 1, said pair of surfaces being oriented at substantially right angles relative to one another and with each of said surfaces being at substantially a right angle relative to the adjacent flattened face.

4. Apparatus for the chipping dissection of elongated logs, comprising;

a pair of spaced apart, opposed milling cutter heads each including a chopping tooth cutter having a pair of opposed, circular faces, with peripheral chopping teeth extending between said faces, and a circular first saw blade adjacent one of said faces, said first saw blade having approximately the same effective diameter as that of said chipping tooth cutter;

a pair of substantially coplanar, cooperating second saw blades spaced from said cutter heads for severing boards from said log after milling thereof by said heads; and means for mounting said heads for rotation about a first axis, and for mounting said second blades for rotation about respective, spaced apart, substantially parallel second axes, said first axis being oriented at substantially a right angle relative to said second axes.

5. Apparatus as set forth in claim 4, said head mounting means including a laterally adjustable carriage for each head respectively, the drives and bearing arrangements for each head being supported by the corresponding carriage.

6. Apparatus as set forth in claim 5, each of said carriages further including structure for vertical adjustment of the corresponding head.

7. Apparatus as set forth in claim 5, said carriages including said means for mounting said second saw blades, together with the drives and bearing arrangements for the respective second saw blades.

* * * * *